US006997601B2

(12) United States Patent
Feldmeier

(10) Patent No.: US 6,997,601 B2
(45) Date of Patent: Feb. 14, 2006

(54) AGITATOR WITH REMOVABLE BLADES FOR SANITARY TANK

(75) Inventor: Robert H. Feldmeier, Fayetteville, NY (US)

(73) Assignee: Feldmeier Equipment, Inc., Syracuse, NY (US)

( * ) Notice: Subject to any disclaimer, the term of this patent is extended or adjusted under 35 U.S.C. 154(b) by 133 days.

(21) Appl. No.: 10/614,952

(22) Filed: Jul. 8, 2003

(65) Prior Publication Data

US 2005/0007873 A1 Jan. 13, 2005

(51) Int. Cl.
*B01F 7/00* (2006.01)

(52) U.S. Cl. ..... 366/331

(58) Field of Classification Search ..... 366/608, 366/331, 279, 138, 325.1, 330.1, 330.2, 330.3, 366/330.4, 330.5, 330.6, 330.7
See application file for complete search history.

(56) References Cited

U.S. PATENT DOCUMENTS

| | | | | |
|---|---|---|---|---|
| 1,808,353 A | | 6/1931 | Jackson | |
| 2,347,195 A | * | 4/1944 | Huff | 366/330.4 |
| 3,388,749 A | * | 6/1968 | Woods et al. | 416/229 R |
| 3,887,169 A | | 6/1975 | Maynard | |
| 4,130,287 A | * | 12/1978 | Ritzie | 277/408 |
| 4,136,886 A | * | 1/1979 | Sjoholm et al. | 277/361 |
| 4,150,921 A | * | 4/1979 | Wennberg et al. | 416/207 |
| 4,168,918 A | | 9/1979 | de Jonge | 366/169 |
| 4,192,332 A | | 3/1980 | Feldmeier | 134/167 R |
| 4,511,255 A | | 4/1985 | Saucier | 366/138 |
| 4,732,396 A | * | 3/1988 | Brigham et al. | 366/349 |
| 4,861,044 A | | 8/1989 | Jay | 277/24 |
| 4,988,303 A | * | 1/1991 | Thomas | 366/331 |
| 5,108,715 A | * | 4/1992 | Jekat et al. | 366/251 |
| 5,152,606 A | * | 10/1992 | Borraccia et al. | 366/331 |
| 5,167,449 A | * | 12/1992 | Killough | 366/247 |
| 5,171,023 A | * | 12/1992 | Scott et al. | 277/401 |
| 5,427,450 A | * | 6/1995 | Gambrill | 366/331 |
| 5,540,449 A | * | 7/1996 | Algers et al. | 277/408 |
| 5,700,086 A | * | 12/1997 | Forslund | 366/331 |
| 5,885,000 A | * | 3/1999 | Miyahara et al. | 366/251 |
| 6,193,409 B1 | * | 2/2001 | Brunson et al. | 366/331 |
| 6,572,261 B1 | * | 6/2003 | Angerhofer et al. | 366/331 |

* cited by examiner

*Primary Examiner*—Tony G. Soohoo
(74) *Attorney, Agent, or Firm*—Bernhard P. Molldrem, Jr.

(57) ABSTRACT

A sanitary tank is provided with a clean-in-place agitator assembly in which the impeller portion is removably installed at the tip or the shaft or along the shaft. A shaft housing that penetrates the wall of the tank employs lip seals around the drive shaft so that cleaning fluid supplied at an inlet pipe will spray out through the interior or distal lip seal for spraying the proximal side of the impeller. The impeller is mounted on a non-round drive portion at the tip of the drive shaft, avoiding need for welding or threaded fasteners. A vertical stirrer or impeller has a square drive shaft with transverse grooves, and blades that are removably fitted into respective pairs of these grooves.

9 Claims, 4 Drawing Sheets

AGITATOR WITH REMOVABLE BLADES FOR SANITARY TANK

BACKGROUND OF THE INVENTION

This invention relates to storage tanks for food products in which hygienic conditions must be maintained, and is more particularly concerned with an agitator having an impeller blade that can be removed and replaced, and which is configured to be cleaned in place.

Storage tanks for processing of liquid food products, such as milk, dairy products, and fruit juices, can be provided in a variety of sizes and shapes, including silo tanks, which are elongated vertically, and horizontal tanks. In order to facilitate the cleaning of the interior of these tanks after a batch of the liquid food product has been drained, a number of clean-in-place techniques have been proposed, both for efficiency and for employee safety. Clean-in-place arrangements typically include one or more upwardly directed spray nozzles with associated tubing permanently installed in the interior of the tank. A cleaning fluid is applied to this system and the fluid sprays against the interior surfaces of the tank to clean any residues off. One clean-in-place arrangement is discussed in my prior U.S. Pat. No. 4,192,332.

For many liquid food product applications, an agitator is installed in the tank, with a shaft that penetrates a seal in the tank wall and an impeller blade or blades supported on the interior end of the drive shaft. Because food process standards do not permit any threaded fasteners to be exposed to the food product, the impeller is typically welded in place onto the end of the shaft. The clean-in-place nozzle can be directed towards the impeller for cleaning purposes, but it can only spray onto the front or distal side of the impeller. Accordingly, clean-in-place agitator arrangements have been proposed that permit the cleaning fluid to be fed under pressure into the shaft housing around the drive shaft. A mechanism such as a spray nozzle on the agitator shaft housing then directs a spray of the cleaning fluid at the proximal side of the impeller. Clean-in-place agitator assemblies have been proposed in U.S. Pat. No. 4,511,255 (Saucier), U.S. Pat. No. 4,168,918 (de Jonge), and U.S. Pat. No. 4,861,044 (Jay). Each of these requires some special configuration of the drive shaft, either so that it can be moved axially to carry out cleaning, that it have spray nozzles installed directly on the drive shaft, or that the drive shaft be provided with an annular flange of greater diameter than the remainder of the shaft.

In addition, the impellers or blades used on agitators of the prior art are welded in place on the tip of the shaft, and cannot be removed except by cutting them off. The need for precision welding makes it more expensive to install the agitator in the tank in the first instance, and also makes it difficult or impossible to reconfigure the agitator for different types of liquid food products. It is sometimes desirable to remove the drive shaft from the drive shaft housing, but because of the welded blade, or other structure present on the drive shaft as mentioned above, it is possible only to remove the drive shaft by pulling it into the interior of the tank, and in many cases it is not possible even to do this without removing the entire shaft housing from the tank. The agitator arrangements of the prior art do not permit removal and replacement of the drive shaft from the exterior, i.e., motor end of the shaft.

OBJECTS AND SUMMARY OF THE INVENTION

It is an object of the present invention to provide a sanitary tank for storage of liquids that avoids the drawbacks of the prior art.

It is another object to provide an agitator for the sanitary tank that permits cleaning in place of the agitator impeller blade using a simple and reliable arrangement.

It is a further object to provide an agitator in which the blade or impeller is held securely on the shaft without welding and without threaded connection, and which can be removed and replaced as need be without difficulty and without special tools.

It is another object to provide a clean-in-place agitator assembly in which during storage of the liquid food product any leakage is only in the direction out of the tank and out of the shaft housing.

It is yet a further object to provide a vertical shaft agitator arrangement in which impeller blades can be removably installed at desired locations along the shaft.

Another object is to make it possible to replace the blades with smaller or larger blades, depending on the material and the tank, for example, for storage of ice cream or skim milk.

Yet another object is to make it possible to use extremely large blades for certain applications, not limited by the size of the tank manway, because the impeller blade is not welded to the shaft.

According to one aspect of the invention, a clean-in-place agitator arrangement is provided for agitating the contents of a sanitary tank, with the tank having an outer wall that can be insulated or non-insulated, and which may have a vertical or horizontal configuration. The agitator is provided with a motor or other drive means at the outside the tank outer wall.

The arrangement has a drive shaft and a shaft housing that is supported in the tank wall. The housing extends from an exterior of the wall to an interior thereof. The shaft housing supports the drive shaft so that a proximal end of the shaft extends out an exterior or proximal end of the shaft housing (exterior of the tank wall) and a distal end of the shaft projects out the other end of the shaft housing within the tank. The shaft housing has a hollow interior that defines an open annulus between the housing and the drive shaft, which can accommodate the cleaning fluid during a clean-in-place operation. The shaft housing includes an inlet pipe or tube, or similar means for admitting a cleaning solution under pressure into the open annulus. The impeller is removably mounted on the distal end of said shaft. In several preferred embodiments, the shaft housing employs a pair of lip seals disposed over the drive shaft at the ends of said shaft housing, respectively. Each lip seal has an annular lip that extends along the drive shaft in the distal direction, so that when said cleaning fluid is applied through said means for admitting, the fluid passes the lip of the lip seal at the interior end of the shaft housing, such that the fluid sprays against a proximal side of said impeller. The lip seal at the outer or proximal end of the shaft housing is oriented so that it closes against the drive shaft under pressure of the cleaning fluid, and so that the cleaning fluid sprays only towards the interior of the tank and against the impeller blade.

In the embodiments of this invention, the distal end of said drive shaft has a non-round portion, and the agitator has a center opening of a profile matching the non-round portion, so that the agitator is held in place on said drive shaft to rotate with the shaft, without welding and without threaded fasteners. The normal rotation of the impeller pushes the liquid in the distal direction, and this forces the blade against the shaft so as to hold the impeller in place. The impeller is not welded on, and can be removed and replaced without special tools when that becomes necessary. In a preferred mode, the drive shaft distal end has a non-round portion, e.g., square, at a tip thereof, and second non-round (e.g., square) portion proximal of the tip, but with a round shaft portion between these two portions. This arrangement will prevent the blade from falling free from the drive shaft, as the blade will be held loose on the round part between the two profiled parts. Preferably, the shaft housing is tilted or sloped at least slightly downward so that fluid inside the housing drains in the proximal direction. This configuration also ensures that any of the liquid food product that leaks into the shaft housing will also drain out harmlessly. Preferably, each lip seal surrounds the shaft and projects along the shaft only in the distal direction.

In a vertical shaft agitator arrangement a vertical drive shaft is employed, which has an upper end in rotational contact with drive means above the top of the tank, and which is rotationally supported by a thrust bearing or the like at the floor of the tank. The drive shaft may have a square profile, or alternatively, a hexagonal or octagonal profile, i.e., a non-round cross section with at least two opposed flat sides. The drive shaft has at least one pair of grooves disposed respectively on the opposed flat sides of the shaft, with the grooves each extending parallel to one another and traversing the flat sides. There is at least one impeller blade situated removably on the shaft. Here each blade has a pair of ears that define a cutout between them. The cutout is dimensioned to fit over said vertical drive shaft with facing edges of the ears that fit slidably into respective ones of the grooves. An end portion of at least one of the ears can be bent so as to retain said impeller blade removably on said drive shaft. The ears can be bent back when it is necessary to slide the impeller blade off the shaft.

The agitator arrangement may employ a square shaft and may have at least some of the pairs of grooves are disposed on first and third sides of said shaft, and others of said pairs of grooves are disposed on second and fourth sides thereof. The grooves may be oriented at a sloping angle across the vertical shaft.

In each case, it is possible to employ other sanitary means to retain the blades on the shaft, e.g., a pin clip or the like.

The above and many other objects, features, and advantages of the agitator arrangement(s) of the present invention will become apparent from the ensuing detailed description of preferred embodiments of the invention, when considered in connection with the accompanying Drawing.

DETAILED DESCRIPTION OF THE PREFERRED EMBODIMENT

Figure 1:
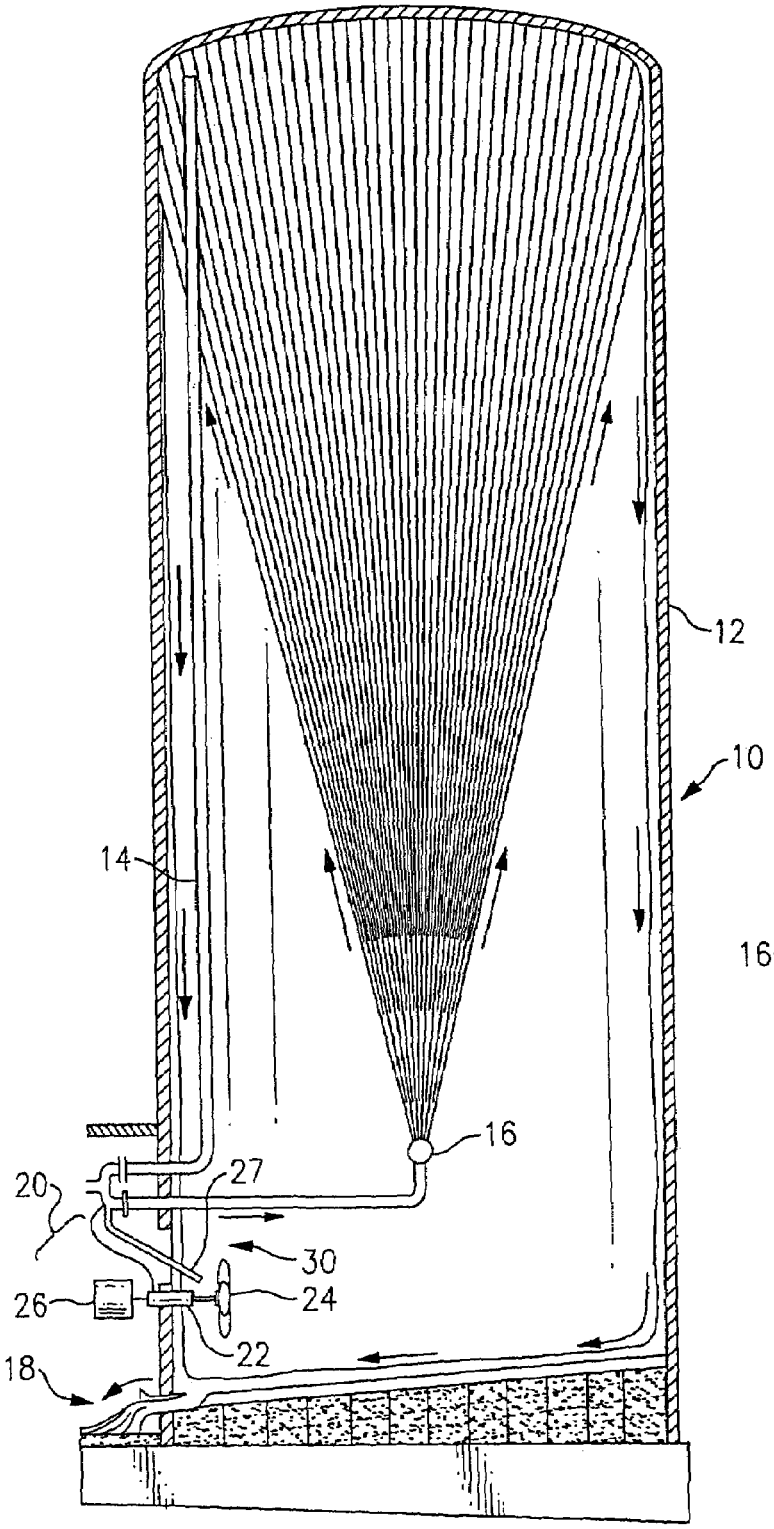
FIG. 1 is a sectional elevation of a vertical silo tank with clean-in-place mechanism and agitator.
Figure 2:
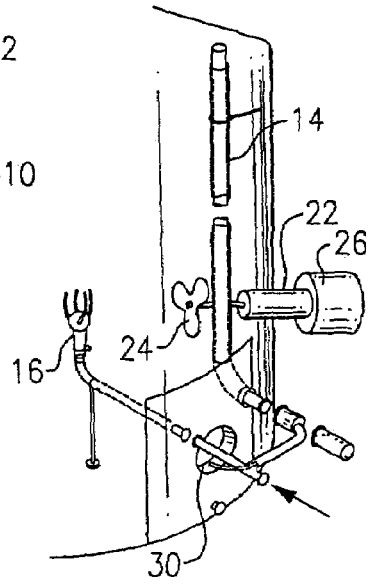
FIG. 2 is a partial elevational view showing an agitator and C-I-P mechanism.

With reference to the Drawing, FIGS. 1 and 2 show a sanitary tank 10 which is favorably formed as a with a cylindrical tank wall 12, as well as a base and top. These tanks are intended for holding dairy products, fruit juices, or other comestible fluids which need to be preserved under sanitary conditions. Not shown here are temperature control arrangements such as refrigeration coils or heat exchangers. The wall 12 may be insulated or uninsulated. While the tank 10 in this view is a vertical or silo tank, the tank may be a horizontal tank, or another configuration. The tanks can be single shell or multiple shell configuration.

The tank is provided with a vertical vent/overflow pipe that runs vertically inside the tank wall 12, and a clean-in-place nozzle or C-I-P nozzle 16 that sprays a cleaning solution upwards and outwards against the interior surfaces of the tank that are to be in contact with the liquid food product. C-I-P technology is generally discussed in the literature, as mentioned previously. A drain 18 is provided at the base of the tank 10 to permit the cleaning fluid, plus any entrained particles, to drain out of the tank.

An agitator assembly 20 is shown here, penetrating through the tank wall 12, with a shaft housing 22 that extends between the interior and exterior of the tank wall, a rotary impeller 24, and an electric motor 26, which powers a drive shaft 28 that is supported in the shaft housing 22. The impeller is mounted on the distal tip of the drive shaft 28.

As shown in FIG. 1, an optional jet 27 may be provided for spraying cleaning fluid against the back or proximal side of the impeller, with the distal side thereof being cleaned by the C-I-P nozzle 16. This jet 27 may be extended into the tank through an access port 30 that is provided near the base of the tank.

Figure 3:
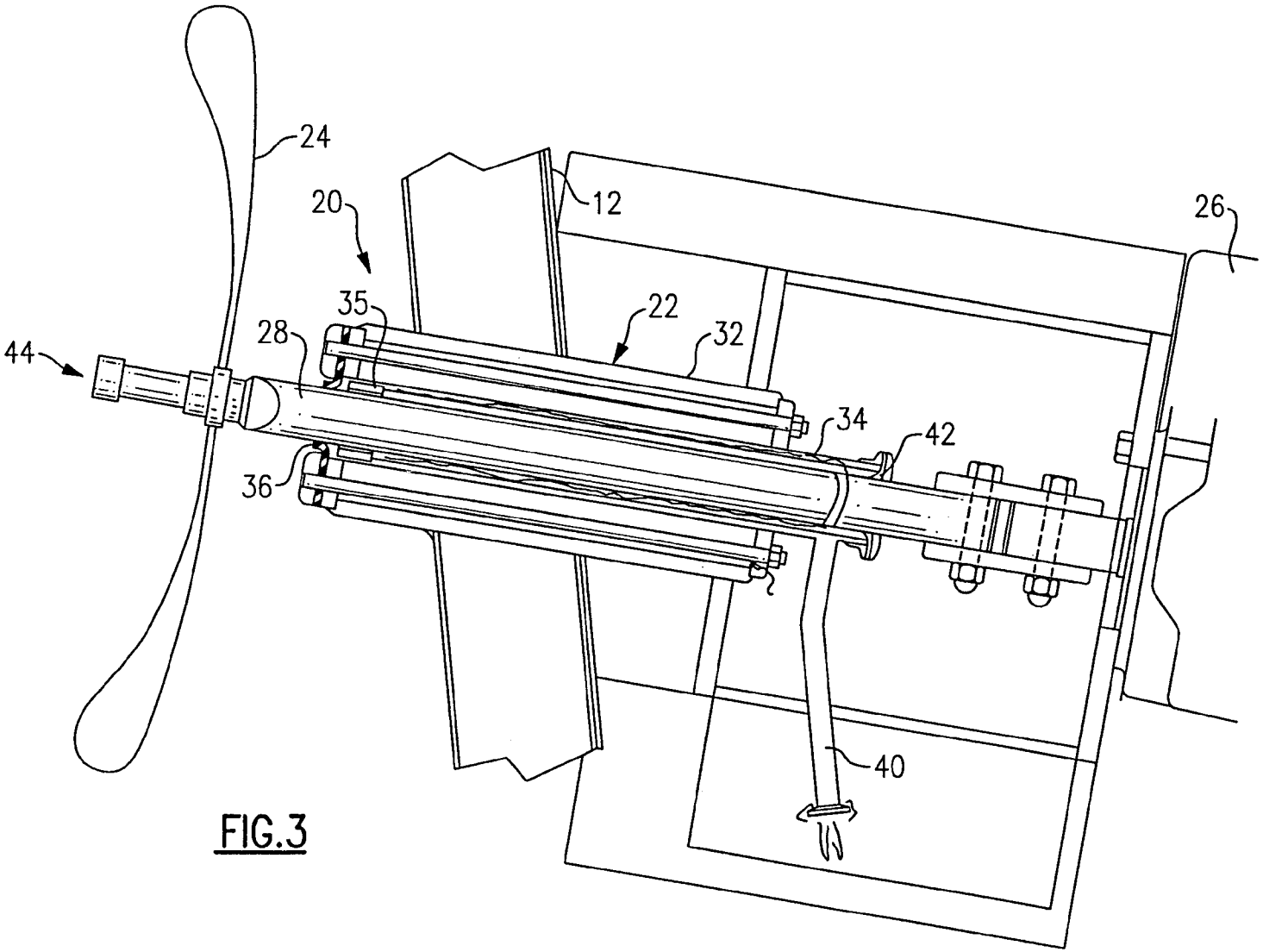
FIG. 3 is a cross section illustrating an clean-in-place agitator with removable blade, according to one embodiment of the invention.

As shown in FIG. 3, the shaft housing 22 of the agitator assembly 20 of one embodiment includes a tubular outer housing 32, with an inner tubular member 34 that defines an annular cavity around the shaft 28. A bearing 35 supports the shaft rotationally. There is a distal lip seal 36 disposed at the distal end of the shaft housing, i.e., within the tank 10, and disposed around the drive shaft 28 where it exits the housing 22. The seal is held in place using bolts 38 that have their head ends at the distal end of the housing and threaded fasteners at the outer or proximal end. An inlet pipe or tube 40 connects with a supply of cleaning liquid (not shown here) to supply same to the annular cavity during a cleaning operation. The tube 40 is oriented downward, as shown here, so that any liquid that enters into the shaft housing during normal use will drain out.

A proximal lip seal 42 or back lip seal is disposed at the proximal end of the shaft housing 22 where the drive shaft exits to connect with the motor or other drive means.

The pair of lip seals 36, 42 are spaced from one another and disposed over the drive shaft 28 at respective ends of the shaft housing 22. The drive shaft 28 has a constant diameter at least through the shaft housing 22 and at the positions of the lip seals 36, 42. The lips of the seals 36, 42 extend along the drive shaft 28 in the distal direction, and lies against the circumferential surface of the drive shaft 28, so that any overpressure in the shaft housing is relieved only in the direction toward the impeller end of the shaft. Thus, when cleaning fluid is applied under pressure during a clean-in-place procedure, the cleaning fluid is applied through the tube 40, and the cleaning fluid exits out under the lip seal 36 so that it sprays against the back or proximal side of the impeller 24. On the other hand, during times when the dairy product or fruit juice, for example, is stored in the tank 10, the pressure of the liquid against the lip seal 36 acts to press the lip against the drive shaft so that the liquid does not exit the tank.

The shaft 28 and shaft housing 22 are tilted so that they slope downward towards the outside of the tank 10, i.e., upward in the distal direction toward the impeller 24. This slope helps ensure that residual fluids inside the shaft housing 22 will drain out of it.

Figure 4:
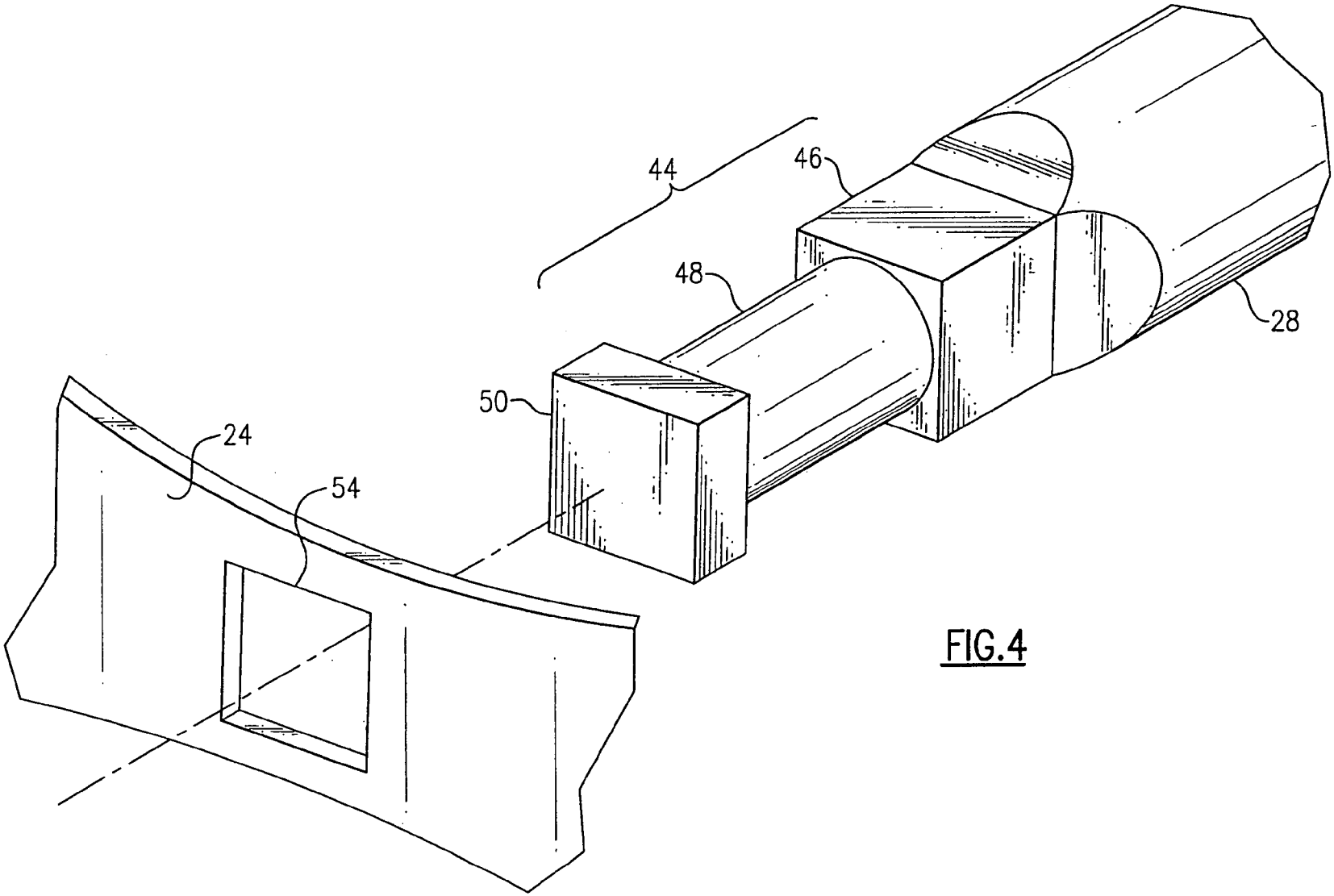
FIG. 4 is a perspective view of the hub portion of an agitator blade or impeller and the distal tip of the drive shaft of an embodiment of this invention.

The details of the impeller 24 and the tip 44 of the drive shaft 28 of one embodiment are illustrated in FIG. 4. In this embodiment, a drive portion 46 of the drive shaft at the tip 44 and connected with the round shaft 28 has two opposed flat surfaces. In this embodiment, the drive portion 46 has a square profile, but in other possible embodiments, some surfaces may be round. In this embodiment, the round drive shaft 28 has the square end 46 adjacent to it, with a round intermediate portion 48 separating a square end portion 50 from the drive portion 46. The impeller blade 24 has a square opening 54 at the hub, dimensioned to fit onto the square drive portion 46. This impeller blade 24 is easily installed by placing the opening 54 first over the square end 50 and then pushing the opening of the hub portion onto the drive portion 46. The hub fits frictionally onto the drive portion, and the rotation of the shaft 28 and impeller 24 is in the direction to drive the impeller 24 further back onto the shaft 28. In the event that the impeller should come loose, the impeller will be retained on the round intermediate portion 48, and rotation of the shaft will not rotate the impeller. When it is necessary to remove the impeller 24 from the shaft 28, this can be done without any special tools and without breaking any welds. The replacement impeller can be installed back onto the end of the shaft without difficulty and without special tools. Of course, instead of a square shaft end as shown here, the tip geometry could include a triangular, hex, or octagonal tip, for example. Also, the number of blades, pitch, and diameter of the impeller can vary from what is shown here.

As the terms are used in respect to embodiments of this invention, round and circular profile mean uniformly round, as applied to the main portion of the drive shaft, and non-round or non-circular mean that there is at least a portion of the profile that is flat or shaped so as to serve as a keyway or drive. Some portion or portions of the non-round profile can actually be arcuate.

In normal operation, the rotational direction of the shaft and impeller will drive the liquid in the tank generally in the distal or forward direction, and this results in pushing the impeller 24 onto the shaft 28. Consequently, in this embodiment the impeller does not have to be welded onto the shaft nor retained by any additional mechanical means. The impeller 24 can be removed from the shaft by pulling it distally, then simply removing the impeller off the tip 44 of the shaft. The same or another impeller 24 can be installed by placing it over the tip 44 of the shaft, then pushing the impeller back until the flat sides of the cut-out 54 are biased in place against the two opposed flat surfaces or the drive portion 46.

In the event that the impeller 24 comes loose, it will be kept from coming off the tip 44. At that point, the displaced impeller would be positioned on the round portion 48 at the tip of the shaft, and the shaft 28 would only spin without rotating the impeller. The upward tilt of the drive shaft 28 on the inside of the tank also acts to keep the impeller in place. Because the blades can be easily removed and replaced, it is possible to use very small impellers or very large impellers, not limited in size by manway opening. That is, the tank can easily be reconfigured from storage of ice cream to storage of skim milk.

Figure 5:
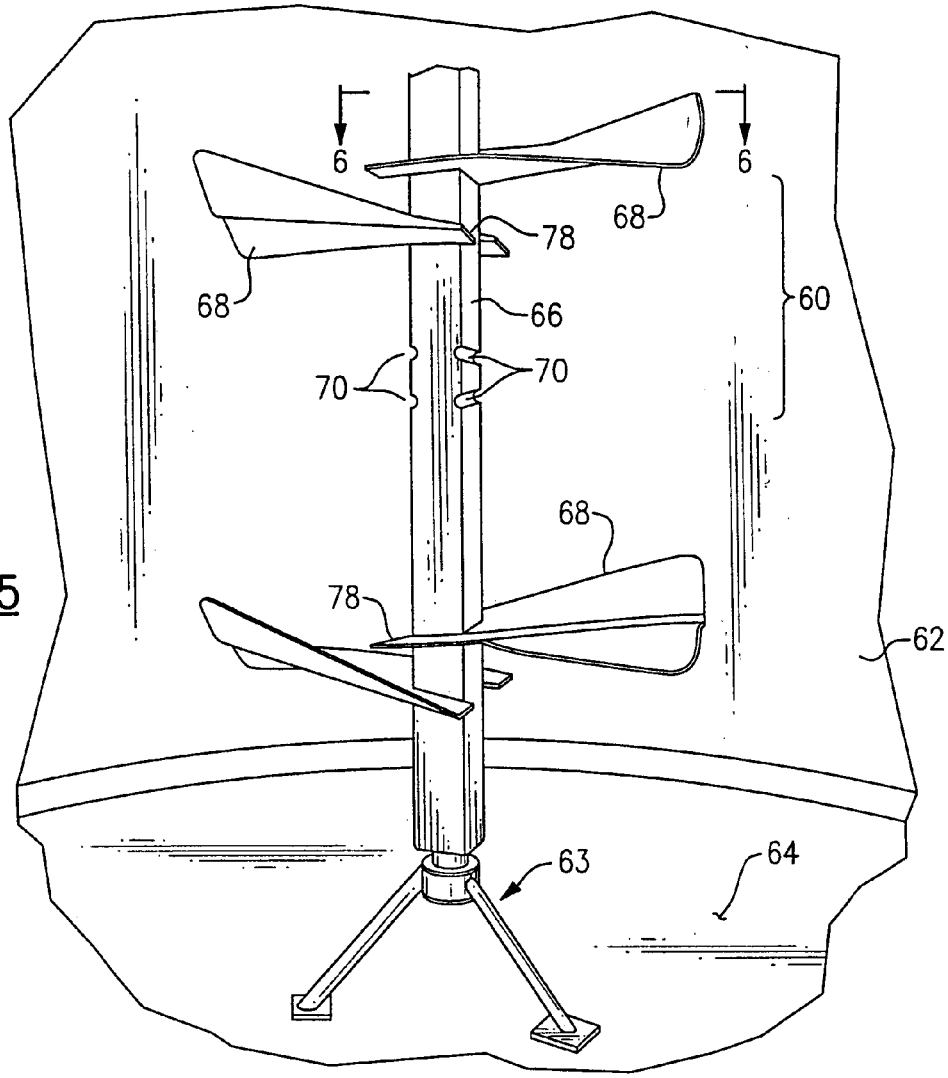
FIG. 5 is a partial perspective view of a vertical-shaft agitator arrangement according to an embodiment of this invention.
Figure 6:
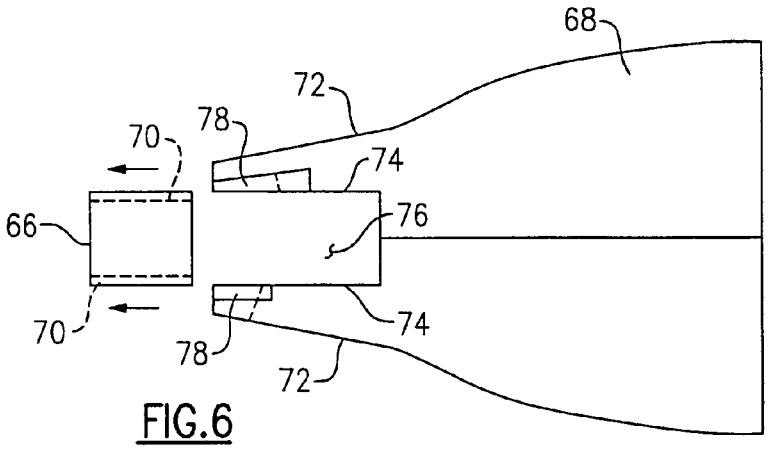
FIG. 6 is a top view of a portion of one blade of the embodiment of FIG. 5.

Another embodiment of this invention is illustrated in FIGS. 5 and 6, in which a vertical shaft agitator 60 is employed in a tank 62, which may be a silo-type tank. A thrust bearing 63 for this agitator is positioned on a floor 64 of the tank, and a drive mechanism (not shown) is positioned above the top of the tank. Here, a vertical drive shaft 66 has a quadrilateral, i.e., square profile, with a number of agitator blades 68 positioned on concave transverse grooves 70 at different heights along the drive shaft. The grooves 70 are arranged in pairs, with each pair of the grooves having the two grooves 70 parallel to one another on opposite sides of the shaft 66. That is, the grooves of each pair may be on the first and third sides, or on the second and fourth sides. In a preferred arrangement there are groups of grooves 70 that are disposed alternately on first and third sides, and then on second and fourth sides. The number, dimension, and positions of blades 68 employed depends on the nature of the liquid being stored in the sanitary tank 62.

As shown in FIG. 6, each blade 68 has a pair of projecting ears 72 at the radially inward end, i.e., where the blade fits onto the shaft. The pair of ears 72 has facing edges 74 that define a cut-out 76, with the edges being parallel and spaced apart such that the two edges fit slidably onto the pair of transverse grooves 70. This allows the blades to be easily installed on the shaft, and changed out as need be. There are bendable portions 78 on each of the ears 72, and these can be deflected or bent once the blade is in place on the shaft, so as to retain the blade in place. The portions 78 can be bent straight when it is desired to remove the blades.

The grooves 70 are also oriented at a small angle to the horizontal, so that the blades 68 will slope slightly upwards.

The blades and shaft can be thoroughly cleaned with a clean-in-place procedure after the product has been drained from the tank. The entire blade and shaft, including the grooves 70, are accessible to the spray of cleaning fluid, so that all contact surfaces will be flushed out.

In each of the above described embodiments, a replacement impeller can be installed back onto the shaft without difficulty and without special tools. Of course, instead of a square shaft or square drive end, as shown here, the shaft geometry could include a triangular, hex, or octagonal shaft or tip. Also, the number of blades, pitch, and diameter of the impeller can vary from what are shown here, which serve only for the purpose of an example.

While the invention has been described with reference to a few selected embodiments, it should be recognized that the invention is not limited to those precise embodiments. Rather, many modifications and variations will be apparent to persons skilled in the art without departing from the scope and spirit of this invention, as defined in the appended claims.

I claim:

1. A clean-in-place agitator arrangement for agitating the contents of a sanitary tank, said tank having an outer wall, with drive means for the agitator arrangement being disposed outside the tank outer wall; the arrangement comprising a drive shaft;

a shaft housing supported in said tank wall and extending from an exterior of said wall to an interior of said tank wall, said shaft housing supporting said drive shaft so that a proximal end thereof extends out an end of the shaft housing exterior of said tank wall and a distal end thereof projects out another end within said tank, said shaft housing having a hollow interior defining an open annulus between the housing and the drive shaft; said shaft housing including means for admitting a cleaning solution under pressure into said open annulus; and an impeller mounted on the distal end of said shaft;

said shaft housing further including a pair of lip seals spaced from one another and disposed over said drive shaft at the respective ends of said shaft housing, said drive shaft having a constant diameter at least through said shaft housing and at the positions of said lip seals; and each said lip seal having an annular lip that extends along said shaft in the distal direction and lies against a circumferential surface of said shaft, so that when said cleaning fluid is applied through said means for admitting, the fluid passes the lip of the lip seal at the interior end of the shaft housing, so that the fluid sprays against a proximal side of said impeller.

2. The clean-in-place agitator arrangement of claim 1 wherein said impeller is removably fitted onto said shaft, the distal end of said drive shaft has a non-round portion, and said impeller has a center opening of a profile matching the non-round portion, so that the impeller is held in place on said drive shaft to rotate with the shaft, without welding and without threaded fasteners.

3. The clean-in-place agitator of claim 1 wherein said drive shaft distal end has a non-round portion at a tip thereof, and second non-round portion proximal of said tip and spaced therefrom by a round shaft portion.

4. The clean-in-place agitator of claim 1 wherein said shaft housing is tilted downward so that fluid inside the housing drains in the proximal direction.

5. The clean-in-place agitator of claim 1 wherein said lip seal surrounds said shaft and projects along the shaft only in the distal direction.

6. The clean-in-place agitator arrangement of claim 1 wherein said drive shaft distal end does not extend radially beyond said diameter, so that the entire proximal side of the impeller is sprayed with said cleaning fluid during a clean-in-place cleaning operation.

7. The clean-in-place agitator arrangement of claim 1 wherein said impeller has a hub that fits frictionally onto the distal end of said shaft.

8. A clean-in-place agitator arrangement for agitating the contents of a sanitary tank, said tank having an outer wall, with drive means for the agitator arrangement being disposed outside the tank outer wall; the arrangement comprising a drive shaft;

a shaft housing supported in said tank wall and extending from an exterior of said wall to an interior of said tank wall, said shaft housing supporting said drive shaft so that a proximal end thereof extends out an end of the shaft housing exterior of said tank wall and a distal end thereof projects out another end within said tank, said shaft housing having a hollow interior defining an open annulus between the housing and the drive shaft; said shaft housing including means for admitting a cleaning solution under pressure into said open annulus; and an impeller removably mounted on the distal end of said shaft;

wherein the distal end of said drive shaft has a non-round portion, and said impeller has a center opening of a profile matching the non-round portion, so that the impeller is held in place on said drive shaft to rotate with the shaft, without welding and without threaded fasteners; and said shaft housing further including at least one lip seal disposed over said drive shaft at the distal end of said shaft housing, said drive shaft having a constant diameter at least through the distal end of said shaft housing, at the positions of said lip seals, and to the distal end of the shaft; said lip seal having an annular lip that extends along said shaft in the distal direction and lies against a circumferential surface of said shaft, so that when said cleaning fluid is applied through said means for admitting, the fluid passes the lip of the lip seal at the interior end of the shaft housing, so that the fluid sprays therefrom and against a proximal side of said impeller, as well as the shaft from said lip seal to said impeller.

9. The clean-in-place agitator of claim 8 wherein said drive shaft distal end has a non-round portion at a tip thereof, and second non-round portion proximal of said tip and spaced therefrom by a round shaft portion.

* * * * *